US006588650B1

(12) United States Patent
Polidori

(10) Patent No.: US 6,588,650 B1
(45) Date of Patent: Jul. 8, 2003

(54) ANTHRAX DETECTING ENVELOPE SYSTEM

(76) Inventor: Anthony Polidori, 1507 Rivershores Way, Tampa, FL (US) 33603

( * ) Notice: Subject to any disclaimer, the term of this patent is extended or adjusted under 35 U.S.C. 154(b) by 0 days.

(21) Appl. No.: 10/008,711

(22) Filed: Nov. 13, 2001

(51) Int. Cl.[7] ..... B65D 27/04
(52) U.S. Cl. ..... 229/71; 229/72; 229/120.32
(58) Field of Search ..... 229/71, 72, 80, 229/309, 314, 120.32; 385/5, 38

(56) References Cited

U.S. PATENT DOCUMENTS

| | | | | | |
|---|---|---|---|---|---|
| 1,148,433 | A | * | 7/1915 | Benedict | 229/71 |
| 1,229,799 | A | * | 6/1917 | Sexton | 206/499 |
| 1,387,717 | A | * | 8/1921 | Hogan | 229/71 |
| 1,799,428 | A | * | 4/1931 | Lewis | 229/71 |
| 1,865,037 | A | * | 6/1932 | Novick | 229/71 |
| 3,408,908 | A | * | 11/1968 | Berkowitz | 156/521 |
| 3,550,841 | A | * | 12/1970 | Berkley | 229/71 |
| 3,835,988 | A | * | 9/1974 | Buttery | 229/162 |
| 4,272,327 | A | * | 6/1981 | Logan | 229/300 |
| 4,444,356 | A | * | 4/1984 | Hays | 206/232 |
| 6,033,115 | A | * | 3/2000 | Zeiler | 206/215 |

FOREIGN PATENT DOCUMENTS

| | | | | |
|---|---|---|---|---|
| FR | 418.678 | * | 12/1910 | 229/71 |
| GB | 149307 | * | 12/1920 | 229/71 |

* cited by examiner

*Primary Examiner*—Jes F. Pascua

(57) ABSTRACT

An anthrax detecting container system comprises a sheet of material. The sheet of material is folded and joined to form a rectangular container. The container has inside and an outside. The container further has a top edge and a bottom edge and two sides edges. The container has front and back portions. A sealable closure is provided along one of the edges. Also provided is an aperture. The aperture is formed in the one portion adjacent to the bottom edge essentially from side edge to side edge. A transparent sheet is provided within the container. An adhesive is provided to seal the sheet to the envelope.

5 Claims, 4 Drawing Sheets

ANTHRAX DETECTING ENVELOPE SYSTEM

BACKGROUND OF THE INVENTION

1. Field of the Invention

The present invention relates to an anthrax detecting envelope system and more particularly pertains to allowing the handler of mail to visually inspect for the presence of anthrax spores interior of the envelope or other container without opening it.

2. Description of the Prior Art

The use of envelopes of known designs and configurations is known in the prior art. More specifically, envelopes of known designs and configurations previously devised and utilized for the purpose of inspecting and opening mail through known methods and apparatuses are known to consist basically of familiar, expected, and obvious structural configurations, notwithstanding the myriad of designs encompassed by the crowded prior art which has been developed for the fulfillment of countless objectives and requirements.

In this respect, the anthrax detecting envelope system according to the present invention provides an apparatus primarily developed for the purpose of allowing the handler of mail to visually inspect for the presence of anthrax spores interior of the envelope or other container without opening it.

Therefore, it can be appreciated that there exists a continuing need for a new and improved anthrax detecting envelope system which can be used for allowing the handler of mail to visually inspect for the presence of anthrax spores interior of the envelope or other container without opening it. In this regard, the present invention substantially fulfills this need.

SUMMARY OF THE INVENTION

The present invention provides an anthrax detecting envelope system. As such, the general purpose of the present invention, which will be described subsequently in greater detail, is to provide a new and improved anthrax detecting envelope system.

To attain this, the present invention essentially comprises a sheet of paper. The sheet is in a generally rectilinear configuration. The sheet has an upper edge and a parallel lower edge. Generally transverse side edges are provided. The sheet has a major fold line. The major fold line extends from edge to edge slightly closer to the lower edge than to the upper edge. In this manner a front of the envelope is created above the major fold line and a back of the envelope below the major fold line. A wing is provided next. The wing extends laterally from the front from each side edge. Vertical fold lines are provided. The vertical fold lines allow the wings to be folded inwardly into contact with the inside of the front. The back is folded upwardly with its edges in contact. with the wings. A line of glue is provided. The glue couples each wing to the inside of the back of the sheet. In this manner a complete U-shaped enclosure for the envelope at its sides and bottom is formed with a major fold line. Next provided is an upwardly extending flap. The flap is in a generally rectangular configuration. The flap is formed as an upward extension adjacent to the upper edge of the envelope front. In this manner a sealable closure is formed between the front and the back adjacent to the flap. A tab is provided. The tab extends laterally outwardly from each lateral extent of the flap to an extent greater than the width of the front and back of the envelope. The inside of the flap and tabs are formed with a pressure sensitive adhesive with a removable peel strip there over. An upper fold line is provided there between coupling the flap to the front of the envelope front. The flap may be folded downwardly and the tear strip removed and then adhesively adhered to the edge of the back there adjacent so that the ends of the flap may be folded around into sealing contact with the front of the envelope to completely seal the envelope. Also provided is an aperture. The aperture is formed in the back of the envelope adjacent to the major fold line essentially from lateral edge to Lateral edge. The aperture extends a distance no greater than 10 percent of the height of the back of the envelope front. A transparent sheet is provided within the envelope. A rectangle of adhesive is provided at the periphery to seal the sheet to the envelope to thereby allow the viewing and inspection of the contents at the bottom of the envelope. Further provided is a strip of a dark colored material. The material is provided within the envelope on the inside behind the transparent sheet. The material facilitates the viewing of light-colored anthrax spores which might be in the envelope. Last provided are three V-shaped supports. The supports are adapted to hold a letter within the envelope. The supports are spaced from the major fold line at the bottom of the envelope. Each support is laterally spaced from each other. Each support has two upper ends with adhesive for securing the supports to the inside of the envelope. In this manner the contents of the envelope is precluded from contacting the bottom of the envelope and from obscuring the view of anthrax spores which might be in the envelope.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved anthrax detecting envelope system which may be easily and efficiently manufactured and marketed.

It is further an object of the present invention to provide a new and improved anthrax detecting envelope system which is of durable and reliable construction.

An even further object of the present invention is to provide a new and improved anthrax detecting envelope system which is susceptible of a low cost of manufacture with regard to both materials and labor, and which accordingly is then susceptible of low prices of sale to the consuming public, thereby making such anthrax detecting envelope system economically available to the buying public.

Even still another object of the present invention is to provide an anthrax detecting envelope system for allowing the handler of mail to visually inspect for the presence of anthrax spores interior of the envelope or other container without opening it.

Lastly, it is an object of the present invention to provide a new and improved anthrax detecting container system comprising a sheet of material. The sheet of material is folded and joined to form a rectangular container. The container has inside and an outside. The container further has a top edge and a bottom edge and two sides edges. The container has front and back portions. A sealable closure is provided along one of the edges. Also provided is an aperture. The aperture is formed in the one portion adjacent to the bottom edge essentially from side edge to side edge. A transparent sheet is provided within the container. An adhesive is provided to seal the sheet to the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
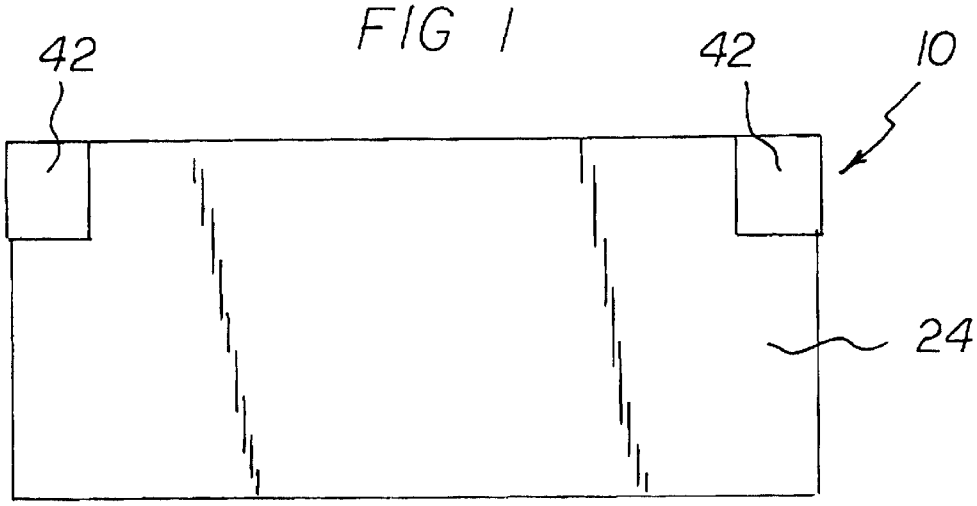
FIG. 1 is a front elevational view of an envelope constructed in accordance with the principles of the present invention.
Figure 2:
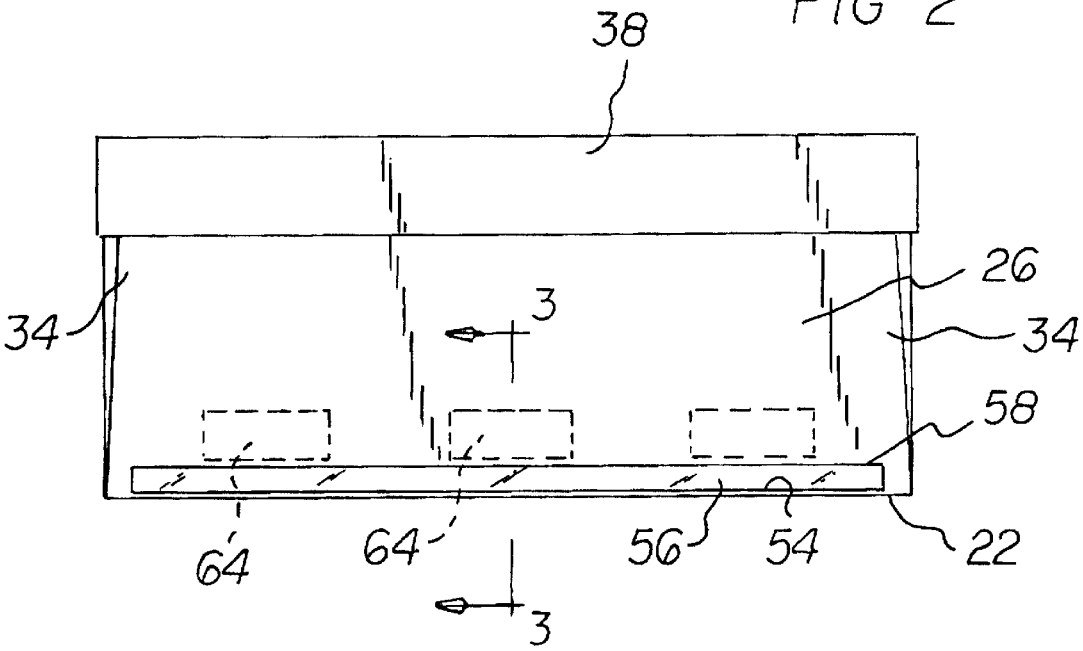
FIG. 2 is a rear elevational view of the envelope shown in FIG. 1.
Figure 3:
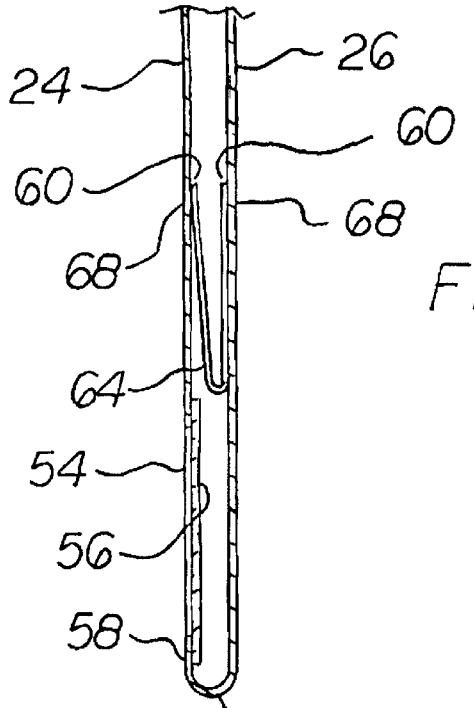
FIG. 3 is a cross-sectional view of taken along line 3—3 of FIG. 2.
Figure 4:
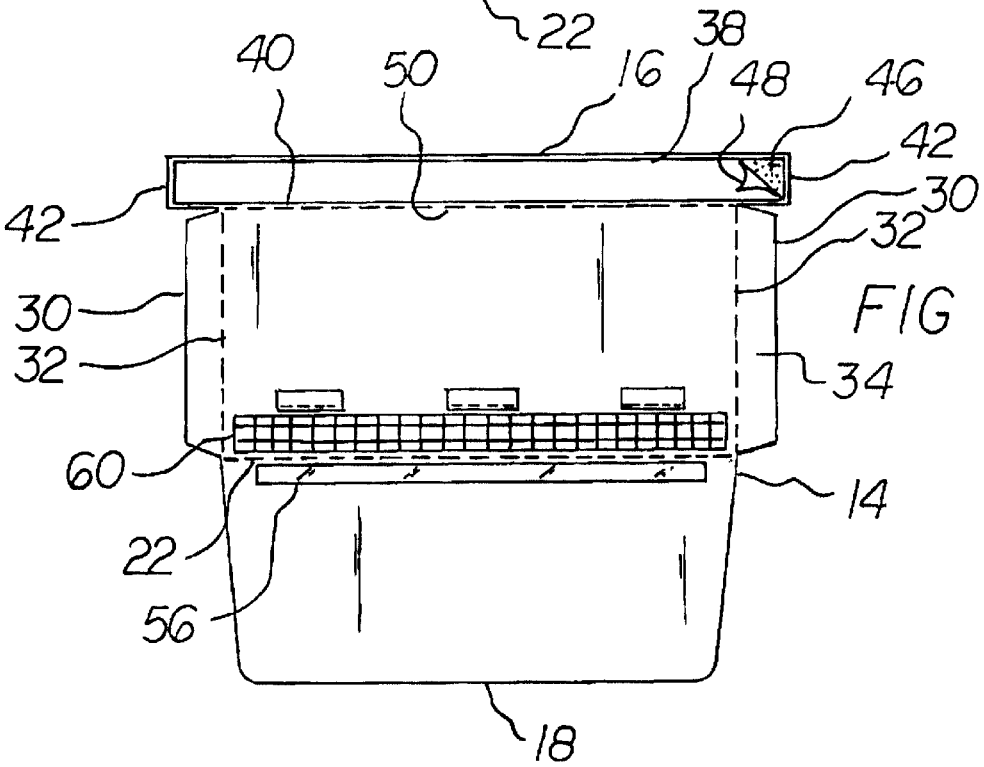
FIG. 4 is a view of the envelope shown in the prior Figures but in a state prior to being folded.

With reference now to the drawings, and in particular to FIG. 1 thereof, the preferred embodiment of the new and improved anthrax detecting envelope system embodying the principles and concepts of the present invention and generally designated by the reference numeral 10 will be described.

The present invention, the anthrax detecting envelope system 10 is comprised of a plurality of components. Such components in their broadest context include a sheet of material and an aperture. Such components are individually configured and correlated with respect to each other so as to attain the desired objective.

First provided is a sheet of paper 14. The sheet is in a generally rectilinear configuration. The sheet has an upper edge 16 and a parallel lower edge 18. Generally transverse side edges 20 are provided. The sheet has a major fold line 22. The major fold line extends from edge to edge slightly closer to the lower edge than to the upper edge. In this manner a front 24 of the envelope is created above the major fold line and a back 26 of the envelope below the major fold line.

A wing 30 is provided next. The wing extends laterally from the front from each side edge. Vertical fold lines 32 are provided. The vertical fold lines allow the wings to be folded inwardly into contact with the inside of the front.

The back is folded upwardly with its edges in contact with the wings. A line of glue 34 is provided. The glue couples each wing to the inside of the back of the sheet. In this manner a complete U-shaped enclosure for the envelope at its sides and bottom is formed with a major fold line.

Next provided is an upwardly extending flap 38. The flap is in a generally rectangular configuration. The flap is formed as an upward extension adjacent to the upper edge of the envelope front. In this manner a sealable closure 40 is formed between the front and the back adjacent to the flap.

A tab 42 is provided. The tab extends laterally outwardly from each lateral extent of the flap to an extent greater than the width of the front and back of the envelope. The inside of the flap and tabs are formed with a pressure sensitive adhesive 46 with a removable peel strip 48 there over. An upper fold line 50 is provided there between coupling the flap to the front of the envelope front. The flap may be folded downwardly and the tear strip removed and then adhesively adhered to the edge of the back there adjacent so that the ends of the flap may be folded around into sealing contact with the front of the envelope to completely seal the envelope.

Also provided is an aperture 54. The aperture is formed in the back of the envelope adjacent to the major fold line essentially from lateral edge to lateral edge. The aperture extends a distance no greater than 10 percent of the height of the back of the envelope front. A transparent sheet 56 is provided within the envelope. A rectangle of adhesive 58 is provided at the periphery to seal the sheet to the envelope to thereby allow the viewing and inspection of the contents at the bottom of the envelope.

Further provided is a strip 60 of a dark colored material. The material is provided within the envelope on the inside behind the transparent sheet. The material facilitates the viewing of light-colored anthrax spores which might be in the envelope.

Last provided are three V-shaped supports 64. The supports are adapted to hold a letter within the envelope. The supports are spaced from the major fold line at the bottom of the envelope. Each support is laterally spaced from each other. Each support has two upper ends 66 with adhesive 68 for securing the supports to the inside of the envelope. In this manner the contents of the envelope is precluded from contacting the bottom of the envelope and from obscuring the view of anthrax spores which might be in the envelope.

Figure 5:
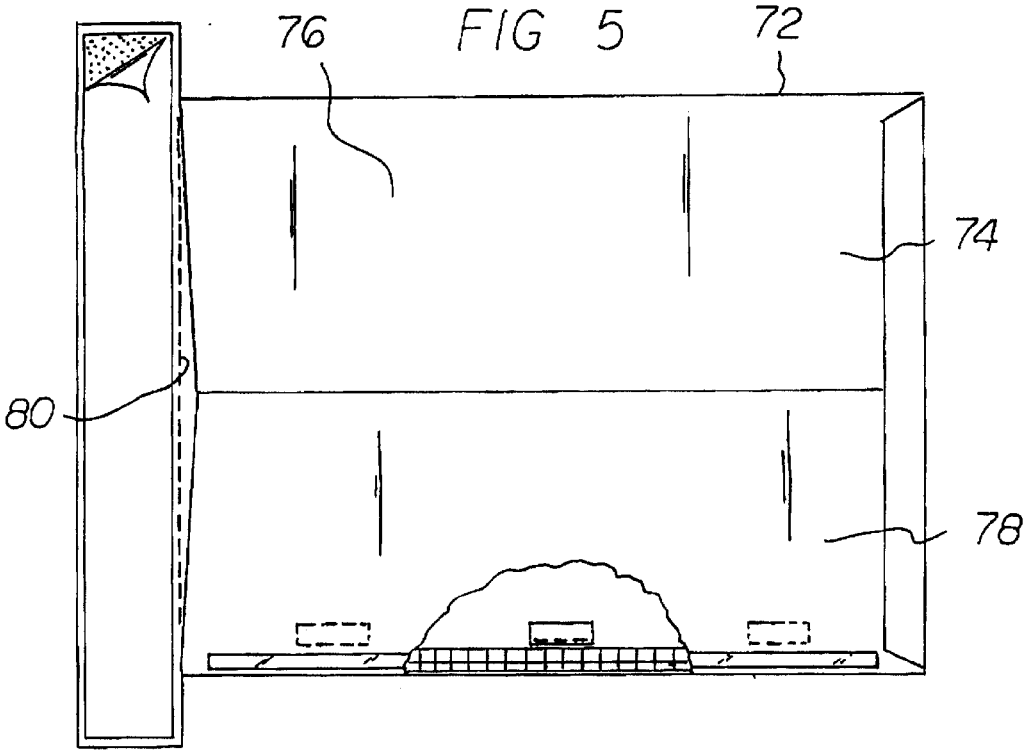
FIG. 5 is a rear elevational view of an envelope constructed in accordance with an alternate embodiment of the invention.

Shown in FIG. 5 is an alternate embodiment of the invention. In such embodiment, the container is an envelope 72 with the closure along one side edge of the envelope. More specifically, the back 74 is of an essentially rectangular configuration. The back is formed of two overlapped rectangular sections 76, 78. The closure 80 is located along one side edge of the envelope.

Figure 6:
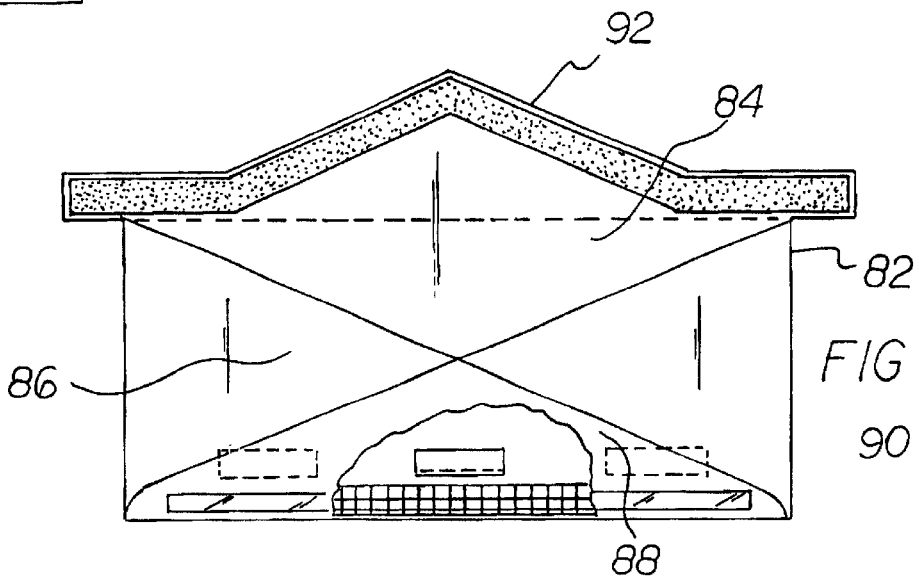
FIG. 6 is a rear elevational view of an envelope constructed in accordance with yet another alternate embodiment of the invention.

Shown in FIG. 6 is another alternate embodiment of the invention. In such embodiment, the container is an envelope formed of a plurality of triangular sections and with the closure along the top of the envelope 82. More specifically, the front 84 of the envelope is of an essentially rectangular configuration. The back is formed of three overlapped triangular sections 86, 88, 90. The closure includes a generally triangular flap 92. The flap is located along the top of the envelope.

Figure 7:
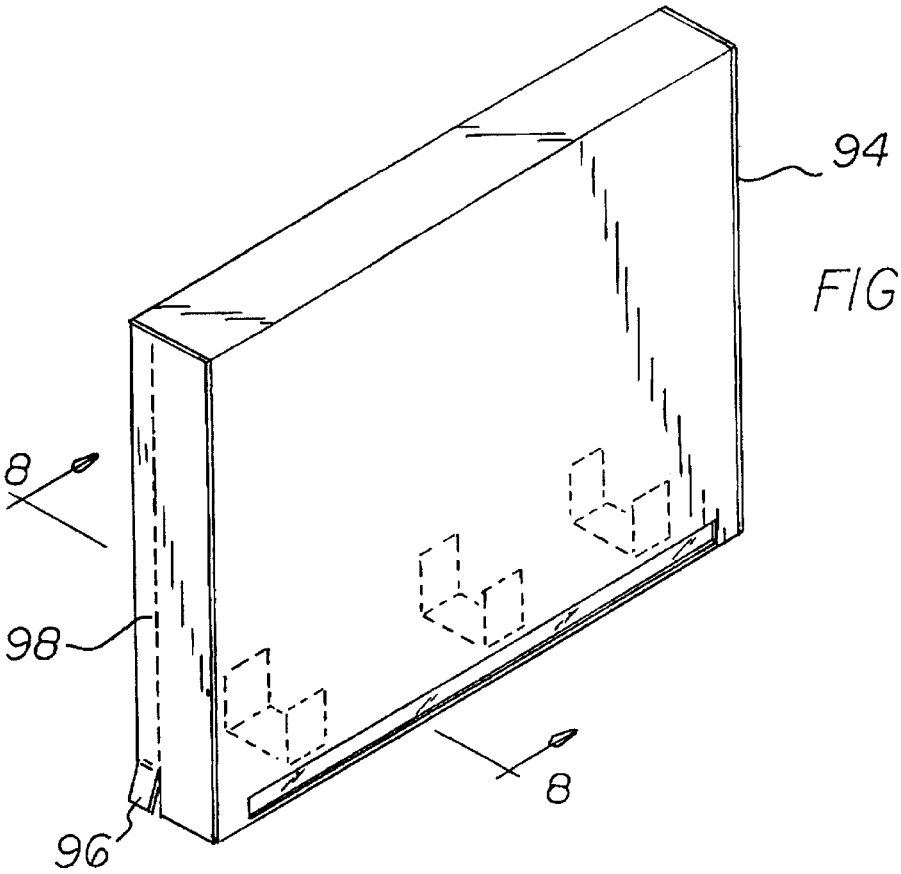
FIG. 7 is a perspective illustration of yet another alternate embodiment of the invention but wherein the container is not an envelope but a box.
Figure 8:
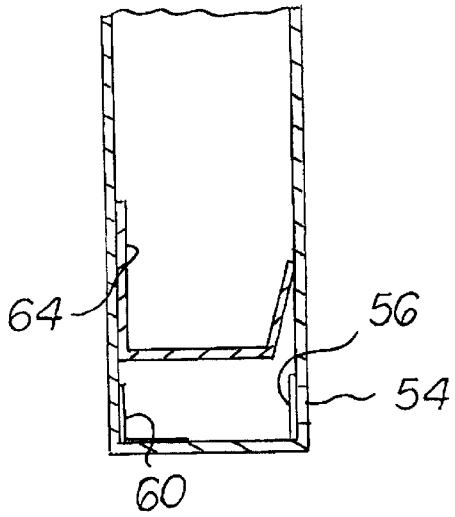
FIG. 8 is a cross-sectional view taken along line 8—8 of FIG. 7.

Shown in FIGS. 7 and 8 is yet another alternate embodiment of the invention. In such embodiment, the container is a box 94. More specifically, the box is in a rectilinear configuration. The closure includes a tab 96. The tab has a tear strip 98 along one edge of the box. The dark, preferably black, strip 60 extends along the inside of the front adjacent to the bottom and into the bottom panel of the box.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anthrax detecting container system comprising:

a sheet of material folded and joined to form a rectangular container with an inside and an outside with a top edge and a bottom edge and two sides edges and a front portion and a back portion and with a sealable closure along one of the edges;

an aperture formed in the one portion adjacent to one edge essentially from side edge to side edge with a transparent sheet within the container and adhesive to seal the sheet to the envelope;

a strip of a dark colored material within the container on the inside behind the transparent sheet to facilitate the viewing of light-colored anthrax spores which might be therein; and supports within the container spaced from the said one edge with adhesive for securing the supports to the inside of the container to preclude the contents of the container from contacting the bottom of the envelope and from obscuring the view of anthrax spores which might be in the container.

2. The system as set forth in claim 1 wherein the container is an envelope wherein the front is of an essentially rectangular configuration and the back is formed of two overlapped rectangular sections and the closure is located along one side edge of the envelope.

3. The system as set forth in claim 1 wherein the container is an envelope wherein the front is of an essentially rectangular configuration and the back is formed of three overlapped triangular sections and the closure includes a generally triangular flap located along the top of the envelope.

4. The system as set forth in claim 1 wherein the container is a box in a rectilinear configuration and the closure includes a tab with a tear strip along one edge of the box.

5. An anthrax detecting envelope system for allowing the handler of mail to visually inspect for the presence of anthrax spores interior of the envelope without opening it comprising, in combination:

a sheet of paper in a generally rectilinear configuration with an upper edge and a parallel lower edge and with generally transverse side edges there between, the sheet having a major fold line extending from edge to edge slightly closer to the lower edge than to the upper edge thereby creating a front of the envelope above the major fold line and a back of the envelope below the major fold line;

a wing extending laterally from the front from each side edge thereof with vertical fold lines allowing the wings to be folded inwardly into contact with the inside of the front;

the back being folded upwardly with its edges in contact with the wings and a line of glue coupling each wing to the inside of the back of the sheet to form with the major fold line a complete U-shaped enclosure for the envelope at its sides and bottom;

an upwardly extending flap in a generally rectangular configuration formed as an upward extension adjacent to the upper edge of the envelope front so that a sealable closure is formed between the front and the back adjacent to the flap;

a tab extending laterally outwardly from each lateral extent of the flap to an extent greater than the width of the front and back of the envelope, the inside of the flap and tabs being formed with a pressure sensitive adhesive with a removable peel strip there over and with an upper fold line there between coupling the flap to the front of the envelope front whereby the flap may be folded downwardly and the tear strip removed and then adhesively adhered to the edge of the back there adjacent so that the ends of the flap may be folded around into sealing contact with the front of the envelope to completely seal the envelope;

an aperture formed in the back of the envelope adjacent to the major fold line essentially from lateral edge to lateral edge and extending a distance no greater than 10 percent of the height of the back of the envelope front with a transparent sheet within the envelope and a rectangle of adhesive at its periphery to seal the sheet to the envelope to thereby allow the viewing and inspection of the contents at the bottom of the envelope there within;

a strip of a dark colored material within the envelope on the inside behind the transparent sheet to facilitate the viewing of light-colored anthrax spores which might be therein; and three V-shaped supports adapted to hold a letter within the envelope spaced from the major fold line at the bottom of the envelope, each strip being laterally spaced from each other, each support having two upper ends with adhesive for securing the supports to the inside of the envelope to preclude the contents of the envelope from contacting the bottom of the envelope and from obscuring the view of anthrax spores which might be in the envelope.

* * * * *